US010313786B1

(12) United States Patent
Bao et al.

(10) Patent No.: US 10,313,786 B1
(45) Date of Patent: Jun. 4, 2019

(54) BEAMFORMING AND GAINSHARING MIXING OF SMALL CIRCULAR ARRAY OF BIDIRECTIONAL MICROPHONES

(71) Applicant: Cisco Technology, Inc., San Jose, CA (US)

(72) Inventors: Feng Bao, Sunnyvale, CA (US); David William Nolan Robison, Campbell, CA (US); Tor A. Sundsbarm, San Jose, CA (US); Fei Yang, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 16/010,774

(22) Filed: Jun. 18, 2018

Related U.S. Application Data

(60) Provisional application No. 62/645,447, filed on Mar. 20, 2018.

(51) Int. Cl.
*H04R 3/00* (2006.01)
*G10L 21/0232* (2013.01)
*H04R 1/40* (2006.01)

(52) U.S. Cl.
CPC ..... *H04R 3/005* (2013.01); *G10L 21/0232* (2013.01); *H04R 1/406* (2013.01)

(58) Field of Classification Search
CPC ..... H04R 3/005; H04R 1/406; G10L 2021/02166; G10L 21/0232
USPC ..... 381/92
See application file for complete search history.

(56) References Cited

U.S. PATENT DOCUMENTS

| | | | | |
|---|---|---|---|---|
| 6,069,961 | A * | 5/2000 | Nakazawa | H04R 3/005 381/122 |
| 9,549,245 | B2 | 1/2017 | Frater | |
| 9,894,434 | B2 | 2/2018 | Rollow, IV et al. | |
| 2004/0175006 | A1 | 9/2004 | Kim et al. | |
| 2014/0278394 | A1 | 9/2014 | Bastyr et al. | |
| 2017/0026741 | A1* | 1/2017 | Yoshino | H04R 1/406 |
| 2017/0034616 | A1* | 2/2017 | Yoshino | H04R 1/326 |

(Continued)

OTHER PUBLICATIONS

"The Amazon Alexa Premium Far-Field Dev Kit", NXP, https://www.nxp.com/support/developer-resources/nxp-designs/the-amazon-alexa-premium-far-field-dev-kit:ALEXA-PREMIUM?fsrch=1&sr=3&pageNum=1, retrieved from the Internet on Jun. 18, 2018, 4 pages.

*Primary Examiner* — Jason R Kurr
(74) *Attorney, Agent, or Firm* — Edell, Shapiro & Finnan, LLC

(57) ABSTRACT

A device including an array of bidirectional microphones optimizes the echo rejection of the bidirectional microphones. The microphone array receives audio from an audio source and generates audio signals from each of the bidirectional microphones. The device forms audio beams from combinations of the audio signals generated from the microphone array. Each audio beam captures audio from either its positive polarity zone or its negative polarity zone. The device determines a direction of the audio source and selects a perpendicular audio beam pair based on the direction of the audio source. The perpendicular audio beam pair includes a primary audio beam aimed toward the direction of the audio source and a secondary beam perpendicular to the primary audio beam. The device generates an output signal by combining the primary audio beam with the secondary audio beam based on polarity zone the audio is captured for each audio beam.

20 Claims, 11 Drawing Sheets

(56) References Cited

U.S. PATENT DOCUMENTS

| | | | | |
|---|---|---|---|---|
| 2017/0345439 | A1 | 11/2017 | Jensen et al. | |
| 2017/0365255 | A1* | 12/2017 | Kupryjanow | G10L 21/034 |
| 2018/0167706 | A1 | 6/2018 | Robison et al. | |

* cited by examiner

BEAMFORMING AND GAINSHARING MIXING OF SMALL CIRCULAR ARRAY OF BIDIRECTIONAL MICROPHONES

PRIORITY CLAIM

This application claims priority to U.S. Provisional Application No. 62/645,447, filed Mar. 20, 2018, the entirety of which is incorporated herein by reference.

TECHNICAL FIELD

The present disclosure relates to audio processing in arrays of bidirectional microphones.

BACKGROUND

In a compact teleconference device, the speaker and microphone are typically placed close to each other. When the distance between the speaker and the microphone is short, omnidirectional microphones pick up considerable echo. Unidirectional microphones also pick up substantial echo, especially in low frequencies, due to the proximity effect. Bidirectional microphones with their axis oriented perpendicular to the speaker, reject echo signals at a significantly better than omnidirectional or unidirectional microphones.

In teleconference devices, small circular arrays of bidirectional microphones may use gain sharing/mixing to cover a room with multiple talkers. However, conventional gain sharing/mixing may result in poor performance due when using bidirectional microphones. Bidirectional microphones pick up sound from either end of the microphone with opposite polarity. When mixing the output of two bidirectional microphones, the polarity of each signal may cause the total output to cancel out a meaningful signal.

BRIEF DESCRIPTION OF THE DRAWINGS

FIG. 10 is a flowchart generating an output audio signal based on the polarity zones of primary and secondary audio beams, according to an example embodiment.

DESCRIPTION OF EXAMPLE EMBODIMENTS

Overview

Figure 1:
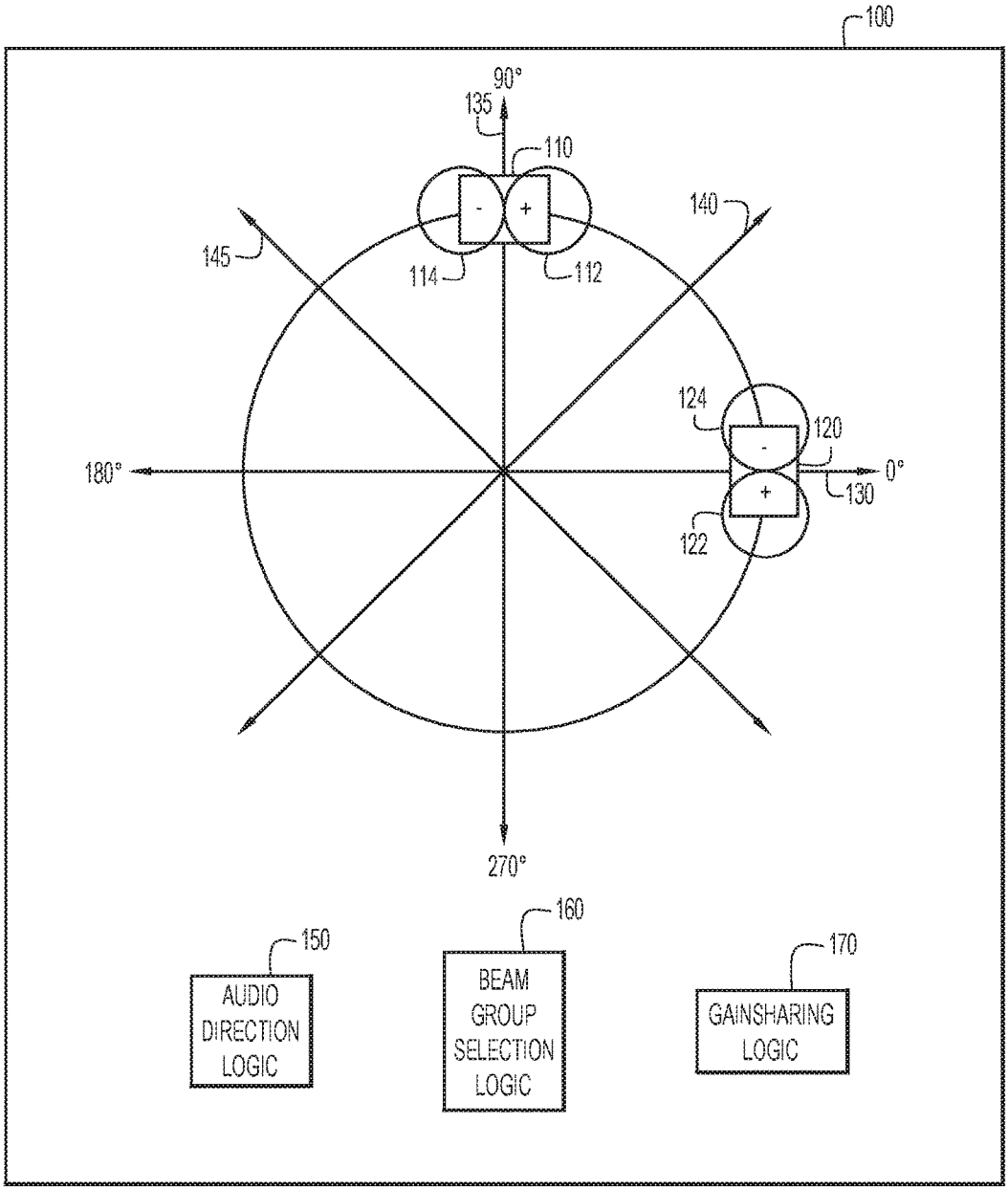
FIG. 1 is a simplified block diagram of a computing device with an array of two bidirectional microphones that form four audio beams, according to an example embodiment.

The techniques presented herein provide a method for a device including a plurality of bidirectional microphones to generate an output audio signal that optimizes the echo rejection of the bidirectional microphones. The method includes receiving audio from an audio source and generating an audio signal from each of the bidirectional microphones. The method further includes forming a plurality of audio beams from combinations of the audio signals generated from the plurality of bidirectional microphones. Each audio beam captures audio from either a respective positive polarity zone or a respective negative polarity zone. The method also includes determining a direction of the audio source and selecting a perpendicular audio beam pair based on the direction of the audio source. The selected perpendicular audio beam pair includes a primary audio beam aimed toward the direction of the audio source and a secondary beam perpendicular to the primary audio beam. The method further includes generating an output signal by combining the primary audio beam with the secondary audio beam based on a comparison of which respective polarity zone the audio is captured for the primary audio beam and the secondary audio beam.

DETAILED DESCRIPTION

Bidirectional microphones have better echo rejection than omnidirectional or unidirectional microphones when the speaker is disposed near the microphones. However, bidirectional microphones picks up audio signals from both a front end (e.g., with positive polarity) and a back end (e.g., with negative polarity). When an audio source is in the positive polarity zone of one microphone and in the negative polarity zone of another, signals from the two microphones may cancel each other out when being mixed together. The techniques described herein use beamforming and gainsharing mixing techniques with small circular array of bidirectional microphones to resolve the polarity conflict of bidirectional microphones when doing gainsharing mixing. In a circular array with three bidirectional microphones, the techniques described herein also provide for a method to estimate sound direction without any ambiguity in determining from which direction (e.g., front or back) a sound originates.

As used herein, bidirectional microphones refer to a sound input device that records audio signals with a positive polarity in one direction and a negative polarity in the opposite direction. A bidirectional microphone may be constructed with a single transducer (e.g., a ribbon) or from an array of multiple transducers (e.g., Micro-Electro-Mechanical System (MEMS)) in an array. A typical pickup pattern of a bidirectional microphone is $\cos(\theta)$, with two lobes in opposite directions along the axis of the microphone and a deep null perpendicular to the axis. From the outputs of two bidirectional microphones spaced Φ degrees apart, a virtual bidirectional microphone pointing to any angle Ψ can be formed by combining the two outputs with gains of c1 and c2, respectively:

$$\cos(\theta+\Phi)=c1*\cos(\theta)+c2*\cos(\theta+\Psi)$$

where $c2=\sin(\Phi)/\sin(\Psi)$; and $$c_1=\frac{-c_2+\sqrt{4-3*c_2^2}}{2}$$

If sound directed from the angle Ψ arrives at two microphones at different times (e.g., the microphones are spaced apart), then a proper delay may be introduced to compensate for the difference.

To cover 360° of space, at least two bidirectional microphones may be used to form a small circular array. The axes of the two microphones are configured to be perpendicular to each other. Each microphone covers 180° of space, with 90° in front of the microphone and 90° behind the microphone. The minimal sensitivity of the two-microphone array is at 45° off the axis of either microphone. A sound at 45° off the axis is picked up 3 dB lower (cos(45°)) than a sound that is on axis (cos) (0°).

Referring to FIG. 1, a simplified block diagram of a computing device 100 with an array of two bidirectional microphones is shown. The device 100 includes a bidirectional microphone 110 including a positive polarity zone 112 and a negative polarity zone 114. The device also includes a bidirectional microphone 120 with a positive polarity zone 122 and a negative polarity zone 124. The two microphones 110 and 120 are arranged perpendicularly and receive audio along audio beams 130 and 135, respectively. Signals from the two microphones 110 and 120 may be combined to capture audio along audio beams 140 and 145 at a 45° angle from either microphone 110 or 120. The device also includes audio direction logic 150, beam group selection logic 160, and gainsharing logic 170. The audio direction logic 150 is configured to determine from what direction audio is being received. The beam group selection logic 160 is configured to select the appropriate pair of perpendicular audio beams such that one of the beam is directed as close as possible to the direction of the audio source. The gainsharing logic 170 is configured to combine the signals from the two selected audio beams in order to generate an output audio signal that optimizes the sensitivity of the microphone array without introducing harsh switching artifacts as audio is received from different directions during a conversation.

In one example, the microphones 110 and 120 produce audio signals S1 and S2 (e.g., audio beams 130 and 135), respectively. Combining S1 and S2 with beamforming may be used to create two more beams S3 and S4 (e.g., audio beams 140 and 145) along the directions of 45°/225° and 135°/315°, respectively. When sound comes from 45°/225°, it reaches two microphones at same time, and no compensation for any difference in the time of arrival is necessary. The two audio beams S3 and S4 may be generated from the microphone outputs S1 and S2 according to:

$$S3=(S1+S2)/\sqrt{3};\text{ and}$$

$$S4=(S1-S2)/\sqrt{3}.$$

With a total of four audio beams (e.g., S1, S2, S3 and S4) covering a room, when there is only one audio source in the room, the audio source is within 22.5° of the central axis one of the beams, leading to a worst case of 0.7 dB down from an audio source that is in line with the axis of one of the audio beams.

When there are multiple audio sources in a room, gainsharing techniques (e.g., implemented by gainsharing logic 170) may smooth the transition between audio sources by mixing more than one beams without attenuating any one source over another source. In this way, each source may be received by the microphone array according to the output:

$$\text{output}=\Sigma a_i*S_i,\text{ where } a_i \text{ is beam gain and } S_i \text{ is beam signal.}$$

Different bidirectional microphones may receive audio from the same source in the room with different polarities. For example, referring to FIG. 1, when an audio source is at 45° (i.e., along audio beam 140), the microphone 110 generates the audio signal S1 with positive polarity, and the microphone 120 generates the audio signal S2 with negative polarity. Simply adding S1 to S2 would reduce the audio signal strength due to the opposing polarity of the signals. In contrast, subtracting S1 from S2 enhances the signal strength.

In another example, when an audio source is at 315°, the polarities of both the signals S1 and S2 are positive, and adding S1 to S2 enhances the signal strength while subtracting S1 from S2 would reduce the signal strength. Consequently, when there are two audio sources, one at 45°, and the other at 315°, simply combining the beams S1 and S2 together attenuates the audio signal from one source while enhancing the audio signal from the other source, regardless of whether the signals are simply mixed by adding or subtracting.

Figure 2:
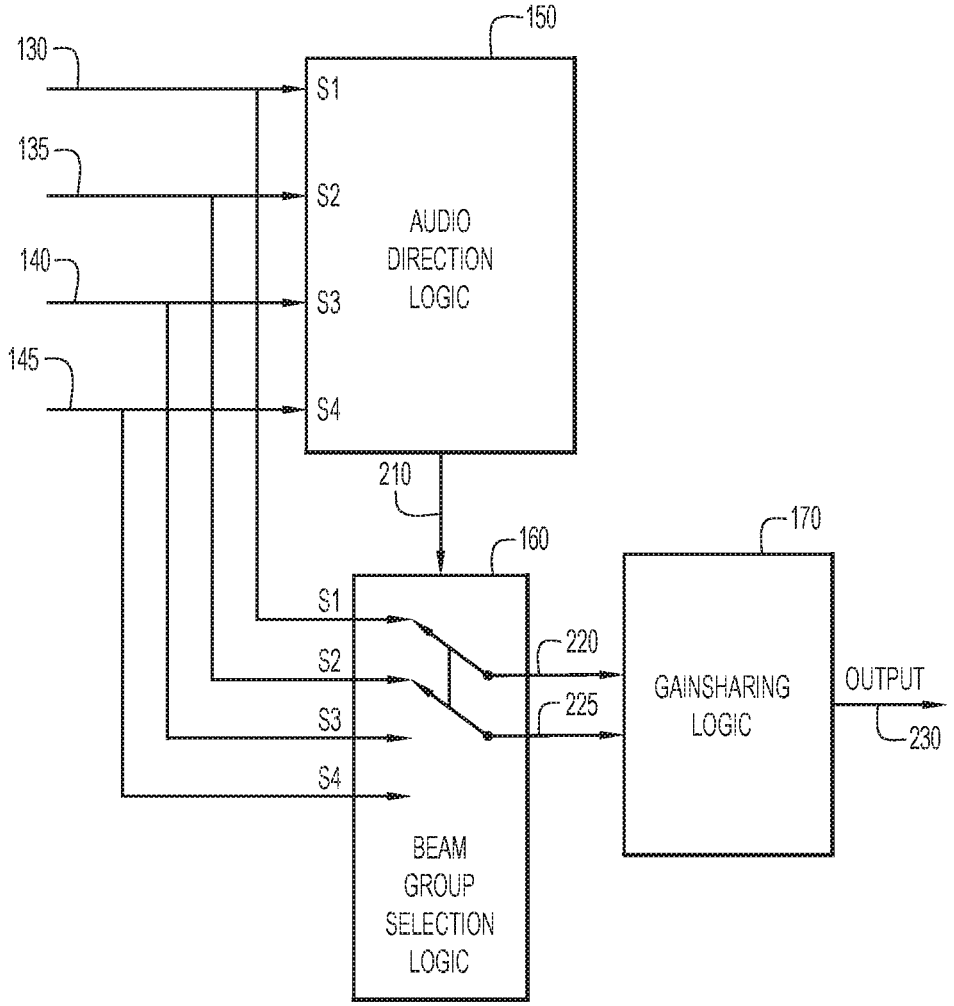
FIG. 2 is a simplified block diagram of the beamforming and gainsharing mixing logic for an array of two bidirectional microphones, according to an example embodiment.

Referring now to FIG. 2, a simplified block diagram shows one example of the signal processing in the device 100 using two bidirectional microphones capturing audio with two pairs of perpendicular audio beams. With continued reference to the configuration of the device 100 shown in FIG. 1, the device captures audio signals S1, S2, S3, and S4 from an audio source in audio beams 130, 135, 140, and 145, respectively. The audio direction logic 150 processes the audio signals to estimate a direction 210 of the audio source relative to the device 100. For instance, the audio direction logic 150 may determine that the audio source is at 40° and pass that direction information 210 to the beam group selection logic 160.

The beam group selection logic 160 receives the location information 210 and the audio signals S1, S2, S3, and S4. The four audio beam signals S1, S2, S3, and S4 mat be divided into two beam groups, such as S1 and S2 in a first audio beam group and S3 and S4 in a second audio beam group. The two beams that form the same beam group (e.g., S3 and S4 in the second audio beam group) point to two directions that are perpendicular to each other. Before mixing the two beams in each group together, the beams should be de-correlated, since the two beams may be formed by the same microphone inputs. A Hilbert filter may be used for purpose of decorrelation, but other schemes such as all pass filters may be used. De-correlated beams in the same group can be mixed together by gainsharing techniques. Each group of beams may be used to cover a whole room with two perpendicular beams. The beam group selection logic 160 selects a beam group with a primary audio beam signal 220 and a secondary audio beam signal 225. The primary audio beam signal 220 and the secondary audio beam signal 225 are sent to the gainsharing logic 170 to be mixed into an output signal 230 that covers the entire room, but is primarily aimed at the audio source.

In one example, bidirectional microphones typically have a deep null at +−90° to the beam axis, and the signal strength does not change significantly about 0°. Using the weakest beam to detect the audio source direction is more reliable and accurate than using strongest beam due to the significant change in sensitivity caused by the deep null. In the audio direction logic 150, the maximum Signal-to-Noise Ratio (SNR) of each of the beams are first measured. If the maximum SNR is above a predefined threshold (THR1), then the current maximum SNR is compared to the previous maximum SNR. If the current SNR is higher than previous maximum SNR, then that is an indication of the rising side of a speech signal. Detecting the audio source direction based on the rising side of speech signal is typically more reliable at detecting a new talker than detecting based on a preset SNR threshold. When the current maximum SNR is above THR1 and higher than previous maximum SNR, the audio direction logic 150 determines the audio beam with the minimum SNR and compares the maximum SNR and the minimum SNR to ensure that the difference is within another predefined threshold (THR2). The audio source direction 210 is initially determined to be perpendicular to the direction of the weakest beam. The other beam in the beam group with the weakest beam should point to talker direction and have the strongest SNR. The audio direction logic 150 may confirm the audio source direction 210 by verifying that the other beam in the group has the strongest SNR, or at least very close to maximum SNR (e.g., within a predefined threshold THR3).

Figure 3:
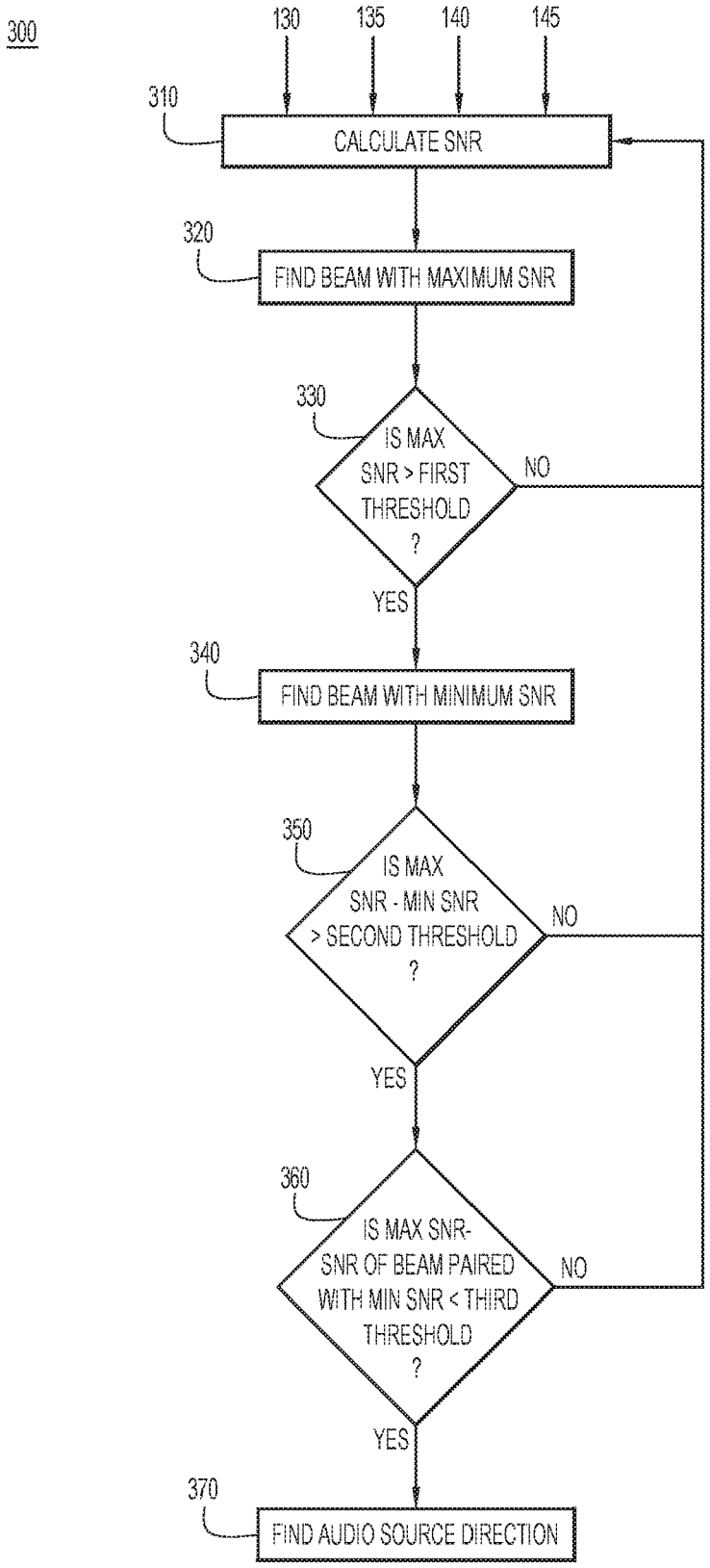
FIG. 3 is a flowchart illustrating the detection of the audio source direction from one of two beam pairs in an array of two bidirectional microphones, according to an example embodiment.

Referring now to FIG. 3, a flowchart illustrates an example of a process 300 performed by the audio direction logic 150 in the device 100 to determine the direction of an audio source. Initially, the audio detection logic 150 receives audio signals from the four audio beams 130, 135, 140, and 145, and calculates the SNR of the audio signal from each audio beam at 310. At 320, the audio direction logic 150 determines which audio beam has the largest SNR. If the maximum SNR does not exceed a first predetermined threshold, as determined at 330, then the audio direction logic 150 returns to calculate the SNR of the next incoming audio signals at 310. If the maximum SNR does exceed the first predetermined threshold, then the audio direction logic 150 finds the beam with the minimum SNR at 340. In one example, the first predetermined threshold may be based on a previously measured maximum SNR. For instance, the maximum SNR may be required to exceed a first threshold of 150% of the previously measured maximum SNR.

The audio direction logic 150 determines whether the difference between the maximum SNR and the minimum SNR exceeds a second predetermined threshold at 350. In one example, this calculation determines whether the difference between the maximum SNR and the minimum SNR does exceed the second predetermined threshold, then the audio direction logic confirms that the audio beam with the minimum SNR is paired with an audio beam that has an SNR within a third predetermined threshold of the maximum SNR at 360. If both the difference between the maximum SNR and the minimum SNR exceeds the second predetermined threshold and the SNR of the beam paired with the weakest SNR beam is within the third predetermined threshold of the maximum SNR, then the audio direction logic 150 determines the audio source direction at 370.

Figure 4:
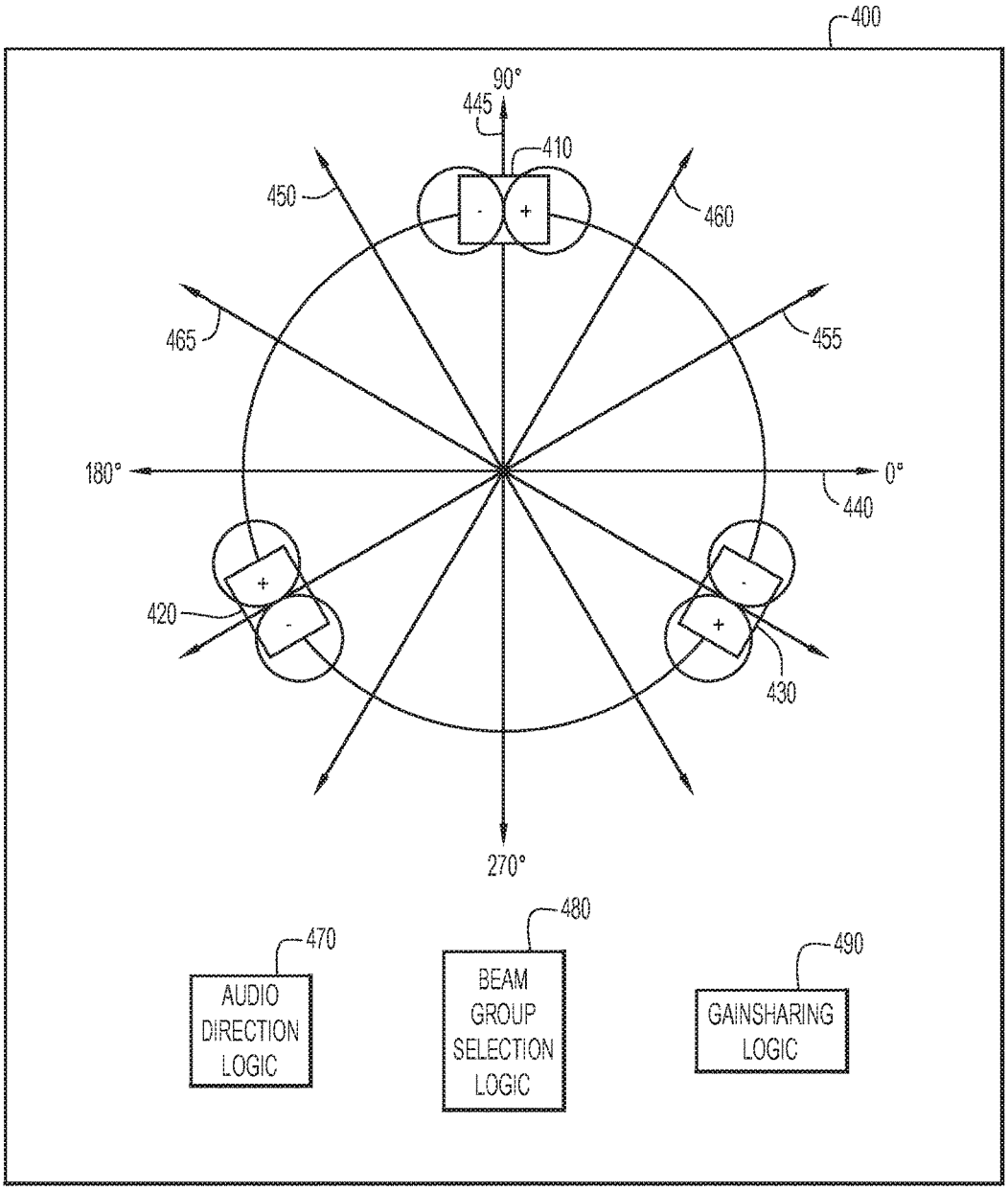
FIG. 4 is a simplified block diagram of a computing device with an array of three bidirectional microphones that form six audio beams, according to an example embodiment.

Referring now to FIG. 4, a simplified block diagram of a computing device 400 with an array of three bidirectional microphones is shown. The device 400 includes bidirectional microphones 410, 420 and 430 even spaced every 120°, which provides better room coverage and more information about the direction of the audio source. Each bidirectional microphone includes respective positive polarity zones and negative polarity zones. The audio signals from each of the bidirectional microphones 410, 420, and 430 are combined to form audio beams 440, 445, 450, 455, 460, and 465. The audio beams are grouped into perpendicular audio beam pairs, such that audio beams 440 and 445 form a first beam pair, audio beams 450 and 455 form a second beam pair, and audio beams 460 and 465 form a third beam pair. The six audio beams 440, 445, 450, 455, 460, and 465 are evenly spaced to capture audio around the device. In other words, an audio beam is directed every 30° around the device.

The device also includes audio direction logic 470, beam group selection logic 480, and gainsharing logic 490. The audio direction logic 470 is configured to determine from what direction audio is being received. The beam group selection logic 480 is configured to select the appropriate pair of perpendicular audio beams such that one of the beam is directed as close as possible to the direction of the audio source. The gainsharing logic 490 is configured to combine the signals from the selected audio beam pair in order to generate an output audio signal that optimizes the sensitivity of the microphone array without introducing harsh switching artifacts as audio is received from different directions during a conversation.

Figure 5:
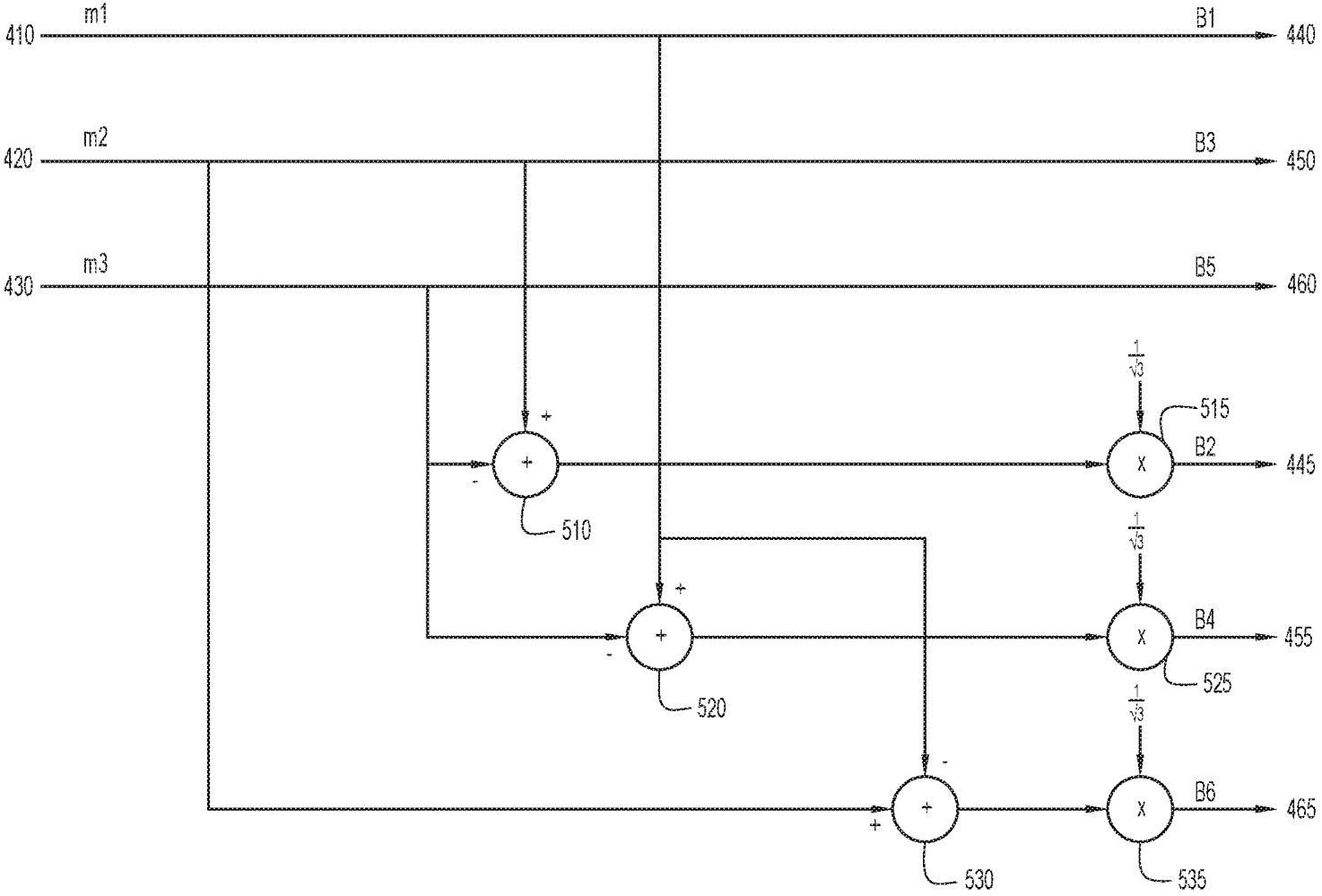
FIG. 5 is a diagram illustrating beamforming of six audio beams from three bidirectional microphones, according to an example embodiment.

Referring now to FIG. 5, a diagram illustrates the beamforming logic that generates the audio beams 440, 445, 450, 455, 460, and 465 by combining the audio signals from the microphones 410, 420, and 430. The three microphones 410, 420, and 430 generate audio signals m1, m2, and m3, respectively. The audio beams 440, 445, 450, 455, 460, and 465 are also denoted as beams B1, B2, B3, B4, B5, and B6, respectively. The audio beams 440, 450, and 460 are generated directly from the output of the microphones 410, 420, and 430, respectively. Audio beam 445 is formed by subtracting the signal m3 (i.e., from the microphone 430) from the signal m2 (i.e., from the microphone 420) at the adder 510 and dividing the result by $\sqrt{3}$ at the multiplier block 515. Similarly, audio beam 455 is formed by subtracting the signal m3 (i.e., from the microphone 430) from the signal m1 (i.e., from the microphone 410) at the adder 520 and dividing the result by $\sqrt{3}$ at the multiplier block 525. Further, audio beam 465 is formed by subtracting the signal m1 (i.e., from the microphone 410) from the signal m2 (i.e., from the microphone 420) at the adder 530 and dividing the result by $\sqrt{3}$ at the multiplier block 535.

In other words, the six audio beams B1, B2, B3, B4, B5, and B6 (e.g., audio beams 440, 445, 450, 455, 460, and 465) may be formed from the audio signals m1, m2, and m3 (e.g., from microphones 410, 420, and 430) according to:

$$B1=m1;$$

$$B2=(m2-m3)/\sqrt{3};$$

$$B3=m2;$$

$$B4=(m1-m3)/\sqrt{3};$$

$$B5=m3;$$

$$B6=(m2-m1)/\sqrt{3}.$$

The six beams are divided into three beam groups: beams B1/B2 are in a first group, beams B3/B4 in a second group, and beams B5/B6 in a third group. The two beams in each group point are perpendicular to each other. Each beam group includes all three microphone inputs with different polarity and gain. The audio direction logic 470 and beam group selection logic 480 may function similarly to the audio direction logic 150 and beam group selection logic 160, described with respect to FIGS. 1 and 2 for two bidirectional microphones, to select a group of audio beams with one audio beam pointing in the direction of the audio source. Gainsharing logic 490, similar to gainsharing logic 170 described with respect to FIGS. 1 and 2, may be used to combine the two audio beams in the selected group to cover whole room. With a total of six beams, the primary beam in the selected group should point to within 15° of the talker. The secondary beam, which is perpendicular to the primary beam, has at least 11.7 dB attenuation (cos(75°)) in the direction of the audio source. With attenuation and room reverberation, the signal components of the two beams from the same audio source are typically de-correlated sufficiently that they can be combined together without a de-correlation process, such as Hilbert filter.

The final output of the microphone array device may be determined by the gainsharing logic to be:

$$\text{output}=g_m*B_m+g_s*p*B_s,$$

where $g_m$, $g_s$ are gains of main beam (i.e., the primary audio beam) and secondary audio beam in the selected perpendicular audio beam group $B_m$, $B_s$ respectively, and p is the polarity of the secondary beam, either +1.0 or −1.0.

To ensure that the gainsharing logic does not attenuate the overall sound signal due to correlation between the main beam and the second beam, the final determination of the polarity of the second beam may be based on a comparison of the power of the overall signal by mixing the main beam and the secondary beam with two different polarities.

$$B_p=B_m+B_s$$

$$B_n=B_m-B_s$$

where $B_p$ is the overall beam output calculated with positive polarity and $B_n$ is the overall beam output calculated with negative polarity.

Figure 6:
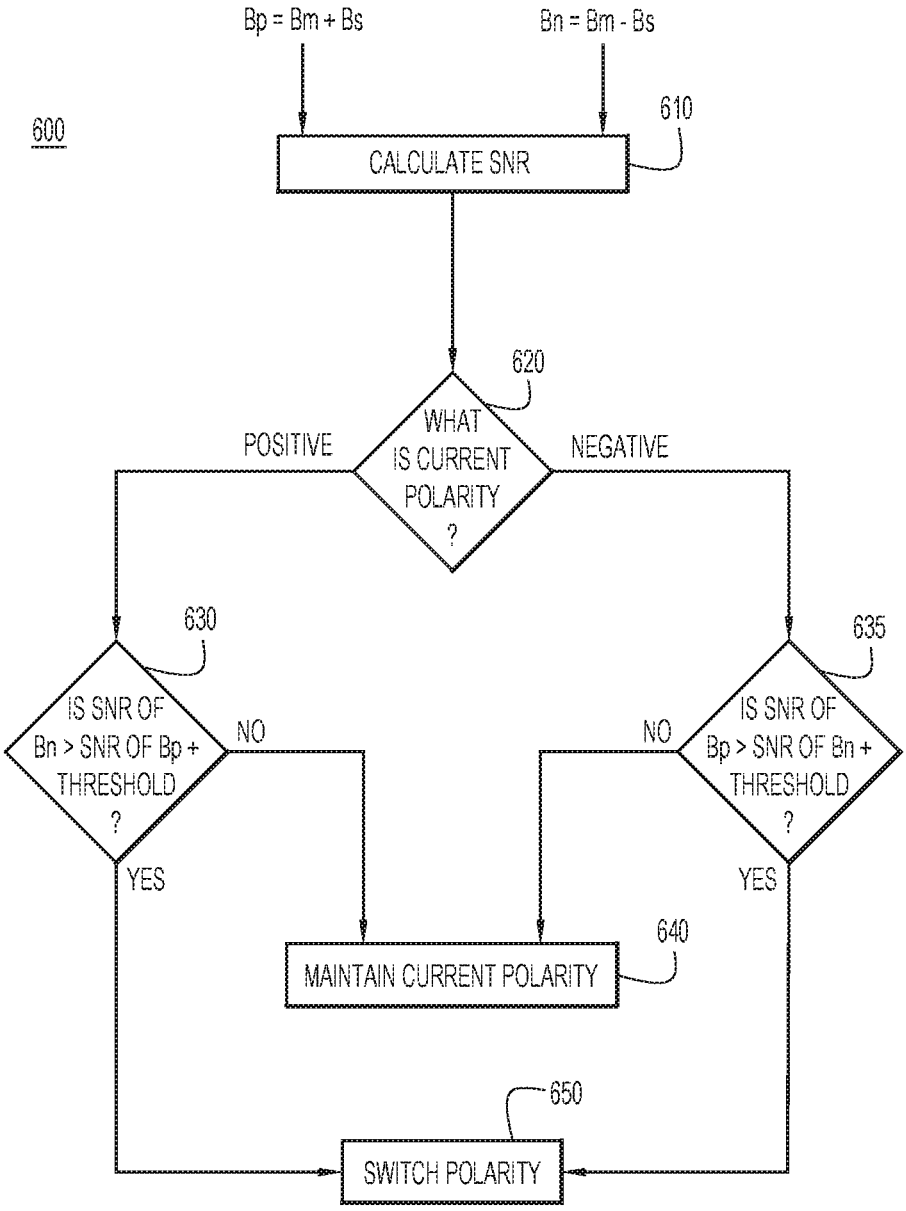
FIG. 6 is a flowchart determining the relative polarity of a signal in two audio beams, according to an example embodiment.

Referring now to FIG. 6, a flowchart illustrates a process 600 to determine whether to switch the polarity of the secondary beam based on the SNR of the overall signals $B_n$ and $B_p$ with a predefined threshold. At 610, the SNR of both $B_n$ and $B_p$ are calculated. In one example, the signals $B_n$ and $B_p$ are calculated from perpendicular audio beams $B_m$ and $B_s$ selected by a beam group selection logic. At 620, the device determines what polarity was used to calculate the previous output signal. If the previous polarity was positive, then the device determines if the SNR of $B_n$ exceeds the SNR of $B_p$ by a predefined threshold at 630. Similarly, if the previous polarity was negative, then the device determines if the SNR of $B_p$ exceeds the SNR of $B_n$ by a predefined threshold at 635. If neither $B_p$ nor $B_n$ exceeds the other by more than the predefined threshold, as determined at 630 or 635, then the device maintains the same polarity at 640. If either $B_p$ or $B_n$ exceeds the other by more than the predefined threshold, as determined at 630 or 635, then the device switches the polarity at 650.

In other words, if the SNR for $B_n$ is higher by more than the predefined threshold, then the polarity switches to negative if the polarity was previously positive, and remains negative if the polarity was previously negative. Similarly, if the SNR for $B_p$ is higher by more than the predefined threshold, then the polarity switches to positive if the polarity was previously negative, and remains positive if the polarity was previously positive. If the SNR for both $B_n$ and $B_p$ are within the predefined threshold, then the polarity remains the same to provide some hysteresis in switching polarity.

Bidirectional microphones do not distinguish whether a sound originates from the front or back. A small array of two bidirectional microphones may retain this ambiguity in sound direction. However, with three bidirectional microphones, assistant audio beams may be formed to differentiate the direction from which a sound originates.

Figure 7:
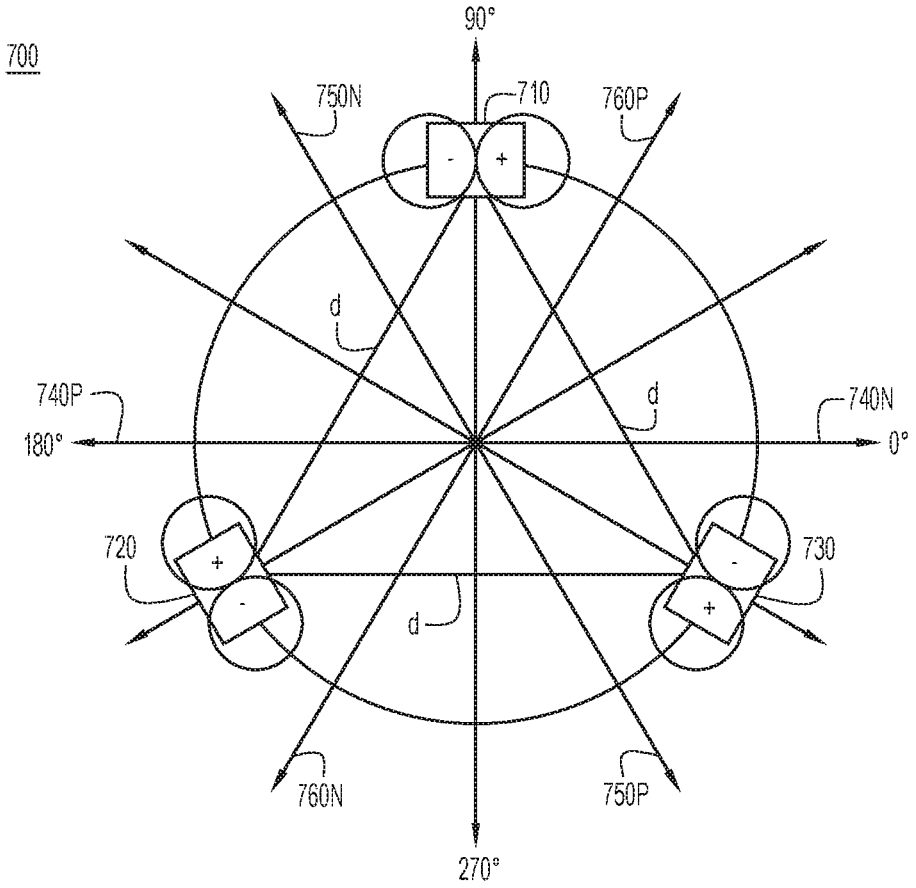
FIG. 7 is a simplified block diagram of a computing device with an array of three bidirectional microphones with a predetermined distance between the microphones, according to an example embodiment.

Referring now to FIG. 7, a simplified block diagram of a microphone array 700 with an array of three bidirectional microphones evenly spaced with a distance between the microphones to use the time difference of arrival of the audio to determine the direction of incoming audio. A microphone 710 points to 0° with its positive polarity zone, and toward 180° with its negative polarity zone. Microphone 720 points to 120° with its positive polarity zone, and toward 300° with its negative polarity zone. Microphone 730 points to 240° with its positive polarity zone, and toward 60° with its negative polarity zone. The distance between each microphone is d, and the speed of sound is s. Assistant audio beams 740N, 740P, 750N, 750P, 760N, and 760P are formed by combining the audio signals of the microphones 710, 720, and 730 with time delays.

When audio comes from 0°, it arrives at microphone 730 before arriving at microphone 720. When audio comes from 180°, it arrives at microphone 720 before arriving at microphone 730. The time difference between the audio arriving at microphone 730 and at microphone 720 is defined by T=d/s. When the audio direction is 0°±30°, the microphone 720 and the microphone 730 receive the audio with the same polarity, with a difference in signal that is at most 1.24 dB)) (cos(30°. Two assistant beams 740P and 740N may be formed as:

$$740P=720(t)-730(t+T);$$

$$740N=720(t+T)-730(t).$$

When the audio direction is 0°+−30°, the SNR of the assistant audio beam 740P would be much lower than that of the assistant audio beam 740N. When audio direction is 180° +−30°, the SNR of the assistant audio beam 740N would be much lower than that of the assistant audio beam 740P. Essentially, the assistant audio beams 740P and 740N behave like a pair of unidirectional, endfire arrays pointing in opposite directions.

Similarly, when audio comes from 60°+−30° or 240°+−30°; or 120°+−30° or 300°+−30°, four more assistant beams 750N, 750P, 760N, and 760P may be formed to detect sound direction:

$$750P=730(t)-710(t+T);$$

$$750N=730(t+T)-710(t);$$

$$760P=710(t)-720(t+T);$$

$$760N=710(t+T)-720(t);$$

Figure 8:
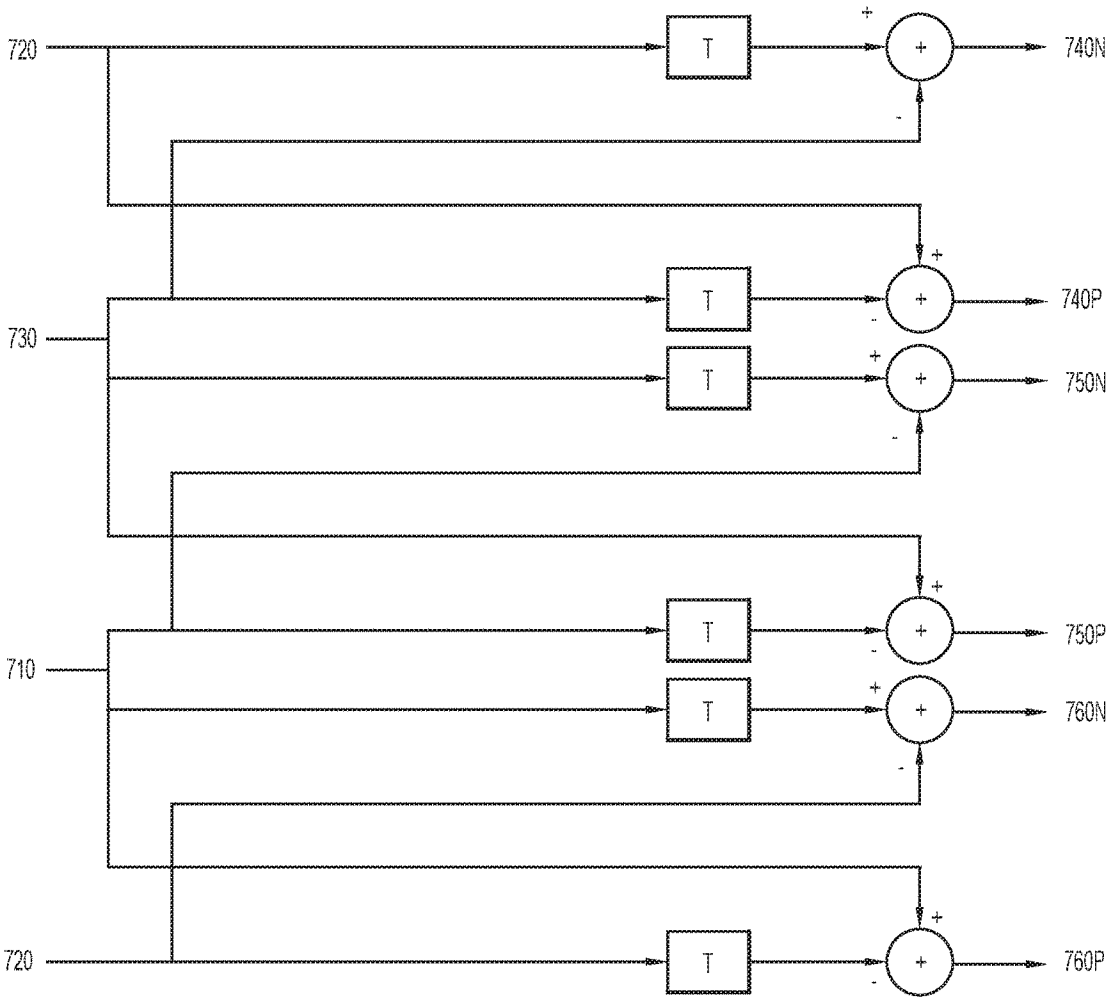
FIG. 8 is a diagram illustrating forming assistant beams used to assist in determining the audio source direction, according to an example embodiment.

FIG. 8 illustrates the formation of each of the assistant beams 740P, 740N, 750P, 750N, 760P, and 760N from combinations of signals from the microphones 710, 720, and 730, along with time delays T defined by the separation of the microphones and the speed of sound.

Assistant beams may also be used to confirm the audio direction estimation and the selection of the primary beam. When there are multiple audio sources at same time from different direction in a room, the difference between the SNR of positive assistant beam (e.g., assistant audio beam 740P) and the negative assistant beam (e.g., assistant audio beam 740N) corresponding to the direction of the strongest beam pointing to the primary audio source would be smaller than when there is only one audio source at the same direction.

Figure 9:
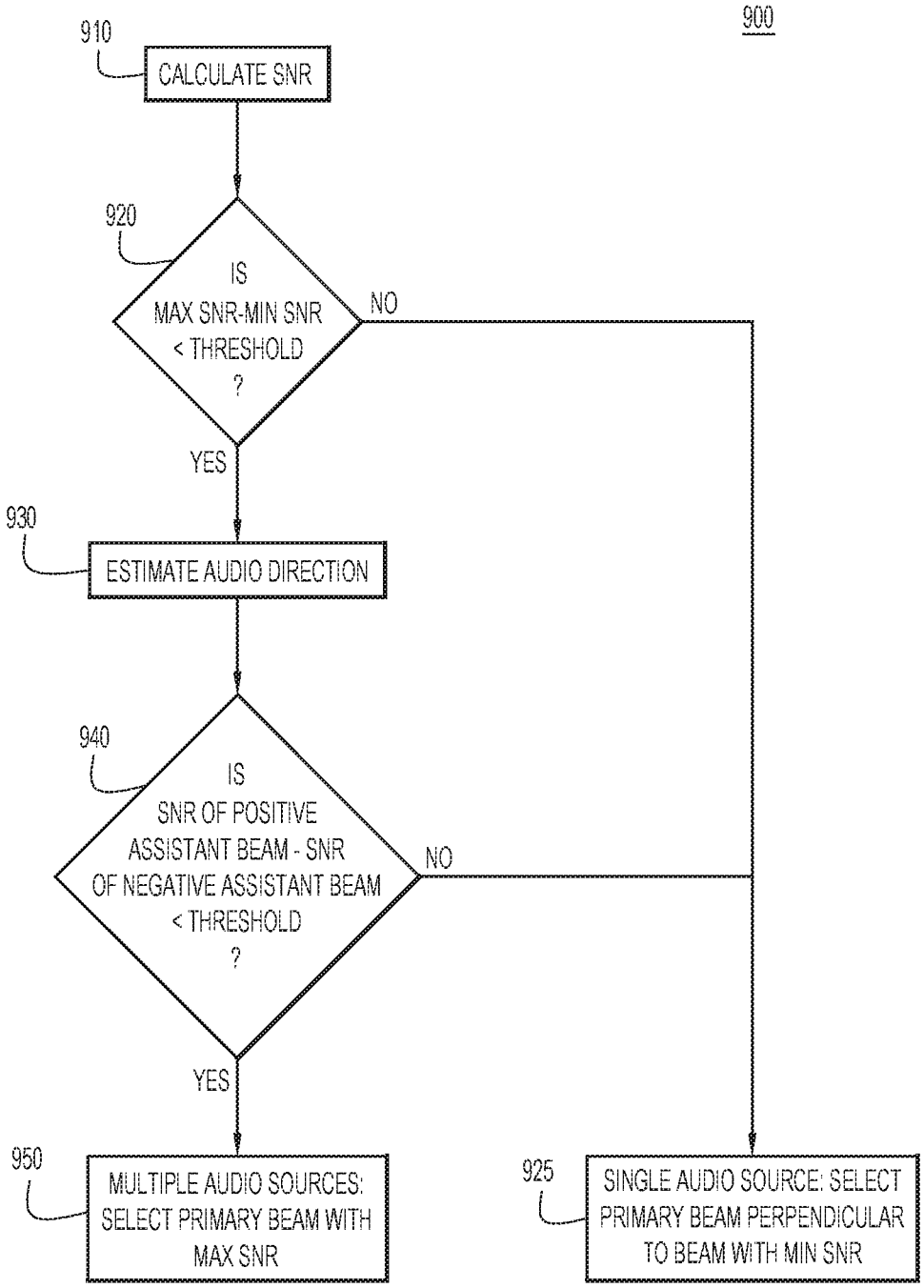

Referring now to FIG. 9, a flowchart illustrates a process 900 by which a computing device determines if multiple audio sources are being captured by the microphone array (e.g., microphone array 700) using assistant audio beams. Initially, the device calculates the SNR of the audio beams captured by the microphone array at 910. If the difference between the maximum SNR and the minimum SNR is not less than a first predetermined threshold, as determined at 920, then the device determines that there are not multiple audio sources at 925 and selects the primary and secondary audio beams according to the techniques described with respect to FIG. 3. If the difference between the maximum SNR and the minimum SNR is less than the first predetermined threshold, then the device proceeds to estimate the audio direction at 930 using the assistant audio beams. If the difference between the positive assistant audio beam (e.g., beam 740P) and the negative assistant audio beam (e.g., beam 740N) is smaller than a second predetermined threshold, as determined at 940, then the device determines that there are multiple audio sources at 950 and selects the primary audio beam based on the beam with the maximum SNR. If the difference between the SNR of the two assistant audio beams is exceeds the second threshold, than the device determines that there is a single audio source at 925, and selects the primary and secondary audio beams according to the techniques described with respect to FIG. 3.

In other words, when the difference between the SNR of assistant audio beams corresponding to direction of strongest beam is less than a predefined threshold Thr_p_n, and the difference between the SNR of strongest beam and the SNR of the weakest beam is less than a predefined threshold Thr_m, then multiple audio sources are detected in the room. In this case, the main bean may be selected simply by using strongest beam, rather than the beam that is perpendicular to the weakest beam.

Figure 10:
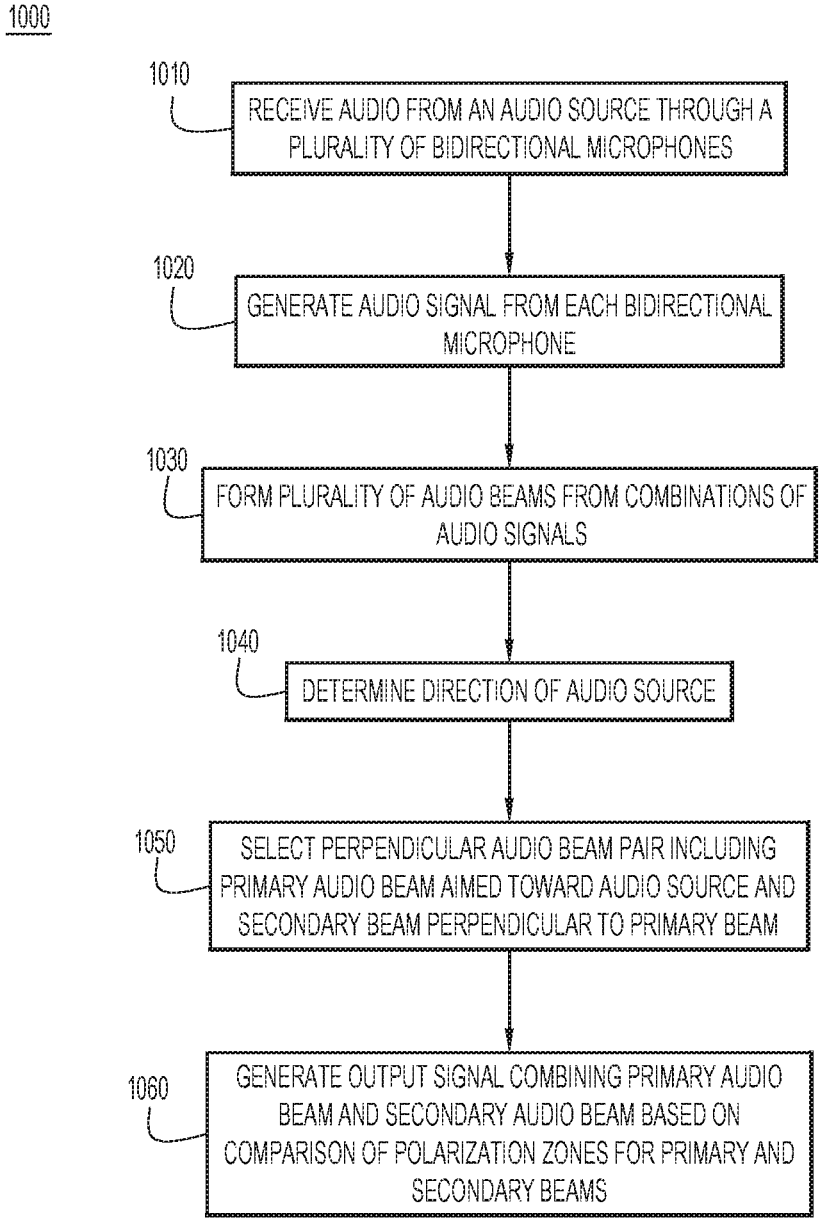
FIG. 10 is a flowchart for estimating whether a single talker or multiple talkers are present in a room, according to an example embodiment.

Referring now to FIG. 10, a flowchart illustrates a process 1000 by which a computing device (e.g., device 100 or 400) selects an audio beam pair and generates an output signal. At 1010, the device receives audio from an audio source. In one example, the device includes a plurality of bidirectional microphones to receive the audio from the audio source. At 1020, the device generates an audio signal from each of the bidirectional microphones. The device forms a plurality of audio beams from combinations of the audio signals generated from the plurality of bidirectional microphones at 1030. Each audio beam captures audio from either a respective positive polarity zone or a respective negative polarity zone.

At 1040, the device determines the direction of the audio source. In one example, the device estimates the direction of the audio source through the SNR of the audio beams. At 1050, the device selects a perpendicular audio beam pair based on the direction of the audio source. The perpendicular audio beam pair includes a primary audio beam aimed closest to the direction of the audio source and a secondary audio beam perpendicular to the primary audio beam. In one example, the device may select the secondary audio beam as having the lowest SNR of the audio beams and the primary audio beam as the audio beam perpendicular to the secondary audio beam. Alternatively, the device may select the primary audio beam as having the highest SNR and the secondary beam as the audio beam perpendicular to the primary beam.

At 1060, the device generates an output signal by combining the primary audio beam with the secondary audio beam based on a comparison of which respective polarity zone the audio is captured for the primary audio beam and the secondary audio beam. In one example, the output signal is generated through gainsharing techniques to minimize artifacts due to switching to a different perpendicular audio beam pair.

Figure 11:
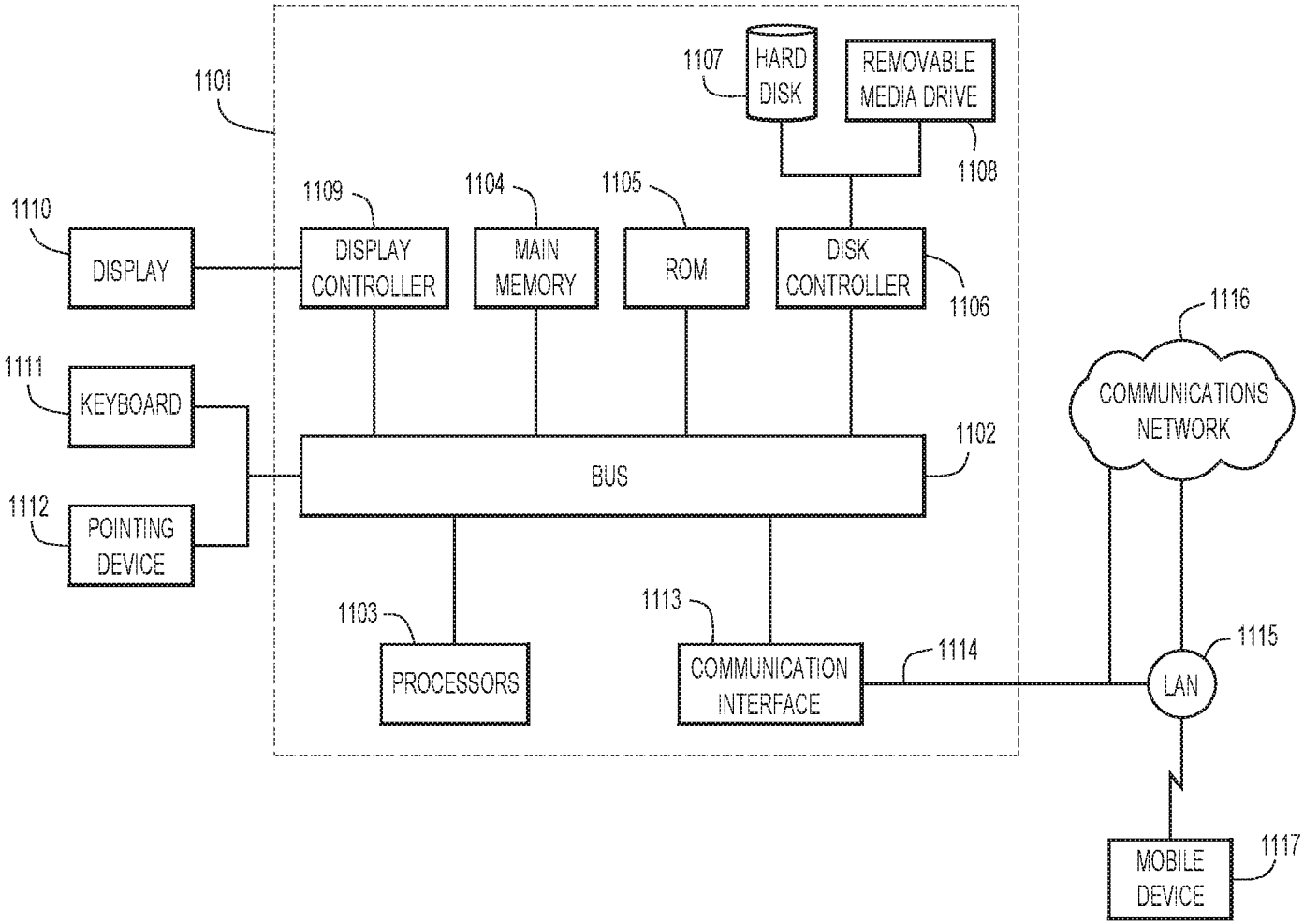
FIG. 11 is a simplified block diagram of a device that may be configured to perform methods presented herein, according to an example embodiment.

Referring now to FIG. 11, an example of a block diagram of a computer system 1101 that may be representative of the computing device 110 in which the embodiments presented may be implemented is shown. The computer system 1101 may be programmed to implement a computer based device, such as a laptop computer, desktop computer, tablet computer, smart phone, internet phone, network element, or other computing device. The computer system 1101 includes a bus 1102 or other communication mechanism for communicating information, and a processor 1103 coupled with the bus 1102 for processing the information. While the figure shows a single block 1103 for a processor, it should be understood that the processors 1103 may represent a plurality of processing cores, each of which can perform separate processing. The computer system 1101 also includes a main memory 1104, such as a random access memory (RAM) or other dynamic storage device (e.g., dynamic RAM (DRAM), static RAM (SRAM), and synchronous DRAM (SD RAM)), coupled to the bus 1102 for storing information and instructions to be executed by processor 1103. In addition, the main memory 1104 may be used for storing temporary variables or other intermediate information during the execution of instructions by the processor 1103.

The computer system 1101 further includes a read only memory (ROM) 1105 or other static storage device (e.g., programmable ROM (PROM), erasable PROM (EPROM), and electrically erasable PROM (EEPROM)) coupled to the bus 1102 for storing static information and instructions for the processor 1103.

The computer system 1101 also includes a disk controller 1106 coupled to the bus 1102 to control one or more storage devices for storing information and instructions, such as a magnetic hard disk 1107, and a removable media drive 1108 (e.g., floppy disk drive, read-only compact disc drive, read/write compact disc drive, compact disc jukebox, tape drive, and removable magneto-optical drive, solid state drive, etc.). The storage devices may be added to the computer system 1101 using an appropriate device interface (e.g., small computer system interface (SCSI), integrated device electronics (IDE), enhanced-IDE (E-IDE), direct memory access (DMA), ultra-DMA, or universal serial bus (USB)).

The computer system 1101 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)), that, in addition to microprocessors and digital signal processors may individually, or collectively, include types of processing circuitry. The processing circuitry may be located in one device or distributed across multiple devices.

The computer system 1101 may also include a display controller 1109 coupled to the bus 1102 to control a display 1110, such as a cathode ray tube (CRT), liquid crystal display (LCD) or light emitting diode (LED) display, for displaying information to a computer user. The computer system 1101 includes input devices, such as a keyboard 1111 and a pointing device 1112, for interacting with a computer user and providing information to the processor 1103. The pointing device 1112, for example, may be a mouse, a trackball, track pad, touch screen, or a pointing stick for communicating direction information and command selections to the processor 1103 and for controlling cursor movement on the display 1110. In addition, a printer may provide printed listings of data stored and/or generated by the computer system 1101.

The computer system 1101 performs a portion or all of the processing steps of the operations presented herein in response to the processor 1103 executing one or more sequences of one or more instructions contained in a memory, such as the main memory 1104. Such instructions may be read into the main memory 1104 from another computer readable storage medium, such as a hard disk 1107 or a removable media drive 1108. One or more processors in a multi-processing arrangement may also be employed to execute the sequences of instructions contained in main memory 1104. In alternative embodiments, hard-wired circuitry may be used in place of or in combination with software instructions. Thus, embodiments are not limited to any specific combination of hardware circuitry and software.

As stated above, the computer system 1101 includes at least one computer readable storage medium or memory for holding instructions programmed according to the embodiments presented, for containing data structures, tables, records, or other data described herein. Examples of computer readable storage media are compact discs, hard disks, floppy disks, tape, magneto-optical disks, PROMs (EPROM, EEPROM, flash EPROM), DRAM, SRAM, SD RAM, or any other magnetic medium, compact discs (e.g., CD-ROM, DVD), or any other optical medium, punch cards, paper tape, or other physical medium with patterns of holes, or any other medium from which a computer can read.

Stored on any one or on a combination of non-transitory computer readable storage media, embodiments presented herein include software for controlling the computer system 1101, for driving a device or devices for implementing the operations presented herein, and for enabling the computer system 1101 to interact with a human user (e.g., a network administrator). Such software may include, but is not limited to, device drivers, operating systems, development tools, and applications software. Such computer readable storage media further includes a computer program product for performing all or a portion (if processing is distributed) of the processing presented herein.

The computer code devices may be any interpretable or executable code mechanism, including but not limited to scripts, interpretable programs, dynamic link libraries (DLLs), Java classes, and complete executable programs. Moreover, parts of the processing may be distributed for better performance, reliability, and/or cost.

The computer system 1101 also includes a communication interface 1113 coupled to the bus 1102. The communication interface 1113 provides a two-way data communication coupling to a network link 1114 that is connected to, for example, a local area network (LAN) 1115, or to another communications network 1116 such as the Internet. For example, the communication interface 1113 may be a wired or wireless network interface card to attach to any packet switched (wired or wireless) LAN. As another example, the communication interface 1113 may be an asymmetrical digital subscriber line (ADSL) card, an integrated services digital network (ISDN) card or a modem to provide a data communication connection to a corresponding type of communications line. Wireless links may also be implemented. In any such implementation, the communication interface 1113 sends and receives electrical, electromagnetic or optical signals that carry digital data streams representing various types of information.

The network link 1114 typically provides data communication through one or more networks to other data devices. For example, the network link 1114 may provide a connection to another computer through a local area network 1115 (e.g., a LAN) or through equipment operated by a service provider, which provides communication services through a communications network 1116. The local network 1114 and the communications network 1116 use, for example, electrical, electromagnetic, or optical signals that carry digital data streams, and the associated physical layer (e.g., CAT 5 cable, coaxial cable, optical fiber, etc.). The signals through the various networks and the signals on the network link 1114 and through the communication interface 1113, which carry the digital data to and from the computer system 1101 may be implemented in baseband signals, or carrier wave based signals. The baseband signals convey the digital data as unmodulated electrical pulses that are descriptive of a stream of digital data bits, where the term "bits" is to be construed broadly to mean symbol, where each symbol conveys at least one or more information bits. The digital data may also be used to modulate a carrier wave, such as with amplitude, phase and/or frequency shift keyed signals that are propagated over a conductive media, or transmitted as electromagnetic waves through a propagation medium. Thus, the digital data may be sent as unmodulated baseband data through a "wired" communication channel and/or sent within a predetermined frequency band, different than baseband, by modulating a carrier wave. The computer system 1101 can transmit and receive data, including program code, through the network(s) 1115 and 1116, the network link 1114 and the communication interface 1113. Moreover, the network link 1114 may provide a connection through a LAN 1115 to a mobile device 1117 such as a personal digital assistant (PDA), tablet computer, laptop computer, or cellular telephone.

In summary, the techniques described herein leverage the improved echo rejection of bidirectional microphones over omnidirectional or unidirectional microphones when a speaker is close to an array of microphones. The output signal from the microphone array is generated by combining beamforming and gainshare mixing while resolving the polarity conflict mixing signals from different bidirectional microphones. Additionally, for arrays of three or more bidirectional arrays, techniques are presented for estimating the direction of the audio source without ambiguity.

In one form, a method is provided for a device including a plurality of bidirectional microphones to generate an output audio signal that optimizes the echo rejection of the bidirectional microphones. The method includes receiving audio from an audio source and generating an audio signal from each of the bidirectional microphones. The method further includes forming a plurality of audio beams from combinations of the audio signals generated from the plurality of bidirectional microphones. Each audio beam captures audio from either a respective positive polarity zone or a respective negative polarity zone. The method also includes determining a direction of the audio source and selecting a perpendicular audio beam pair based on the direction of the audio source. The selected perpendicular audio beam pair includes a primary audio beam aimed toward the direction of the audio source and a secondary beam perpendicular to the primary audio beam. The method further includes generating an output signal by combining the primary audio beam with the secondary audio beam based on a comparison of which respective polarity zone the audio is captured for the primary audio beam and the secondary audio beam.

In another form, an apparatus is provided comprising plurality of bidirectional microphones and a processor. Each bidirectional microphone is configured to receive audio from an audio source and generate an audio signal. The processor is configured to for a plurality of audio beams from combinations of the audio signals generated from the plurality of bidirectional microphones. Each audio beam captures audio from either a respective positive polarity zone or a respective negative polarity zone. The processor is also configured to determine a direction of the audio source and select a perpendicular audio beam pair based on the direction of the audio source. The selected audio beam pair includes a primary audio beam aimed toward the direction of the audio source and a secondary audio beam perpendicular to the primary audio beam. The processor is further configured to generate an output signal by combining the primary audio beam with the secondary audio beam based on a comparison of which respective polarity zones the audio is captured for the primary audio beam and the secondary audio beam.

In yet another form, one or more non-transitory computer readable storage media is encoded with software comprising computer executable instructions and, when the software is executed by a processor, cause the processor to receive audio of an audio source at a plurality of bidirectional microphones and generate an audio signal from each of the bidirectional microphones. The software is operable to cause the processor to form a plurality of audio beams from combinations of the audio signals generated from the plurality of bidirectional microphones. Each audio beam captures audio from either a respective positive polarity zone or a respective negative polarity zone. The software is also operable to cause the processor to determine a direction of the audio source and select a perpendicular audio beam pair. The selected perpendicular audio beam pair includes a primary audio beam aimed toward the direction of the audio source and a secondary audio beam perpendicular to the primary audio beam. The software is further operable to cause the processor to generate an output signal by combining the primary audio beam with the secondary audio beam based on a comparison of which respective polarity zones the audio is captured for the primary audio beam and the secondary audio beam.

The above description is intended by way of example only. The present disclosure has been described in detail with reference to particular arrangements and configurations, these example configurations and arrangements may be changed significantly without departing from the scope of the present disclosure. Moreover, certain components may be combined, separated, eliminated, or added based on particular needs and implementations. Although the techniques are illustrated and described herein as embodied in one or more specific examples, it is nevertheless not intended to be limited to the details shown, since various modifications and structural changes may be made within the scope and range of equivalents of this disclosure. For instance, while microphone arrays with greater than three bidirectional microphones are not explicitly described herein, similar techniques may be adapted to provide larger microphone arrays with the polarity-sensitive techniques described herein.

What is claimed is:

1. A method comprising:

at a device including a plurality of bidirectional microphones, receiving audio from an audio source;

generating an audio signal from each of the bidirectional microphones;

forming a plurality of audio beams from combinations of the audio signals generated from the plurality of bidirectional microphones, wherein each audio beam captures audio from either a respective positive polarity zone or a respective negative polarity zone;

determining a direction of the audio source;

selecting a perpendicular audio beam pair based on the direction of the audio source, wherein the selected perpendicular audio beam pair includes a primary audio beam aimed toward the direction of the audio source and a secondary audio beam perpendicular to the primary audio beam; and generating an output signal by combining the primary audio beam with the secondary audio beam based on a comparison of which respective polarity zones the audio is captured for the primary audio beam and the secondary audio beam.

2. The method of claim 1, further comprising calculating a signal-to-noise ratio (SNR) of each audio beam, wherein the direction of the audio source is determined based on a comparison of the calculated SNRs of the audio beams.

3. The method of claim 2, wherein selecting the perpendicular audio beam pair further comprises:

determining a maximum SNR among the calculated SNRs of the audio beams; and responsive to a determination that the maximum SNR is higher than a previously determined maximum SNR, selecting an audio beam with a minimum SNR as the secondary audio beam and selecting an audio beam perpendicular to the secondary audio beam as the primary audio beam.

4. The method of claim 3, wherein the determination that the maximum SNR is higher than the previously determined maximum SNR includes a determination that the maximum SNR exceeds the previously determined maximum SNR by a first predetermined threshold.

5. The method of claim 4, further comprising:

calculating a difference between the maximum SNR and the minimum SNR;

comparing the difference to a second predetermined threshold; and selecting the audio beam with the minimum SNR as the secondary audio beam only if the difference is greater than the second predetermined threshold.

6. The method of claim 5, further comprising selecting the audio beam perpendicular to the secondary audio beam as the primary audio beam only if the SNR of the audio beam perpendicular to the secondary audio beam is within a third predetermined threshold of the maximum SNR.

7. The method of claim 1, wherein at least one of the audio beams is formed by combining a first audio signal from a first bidirectional microphone with a time delayed second audio signal from a second bidirectional microphone.

8. An apparatus comprising:

a plurality of bidirectional microphones, each bidirectional microphone configured to receive audio from an audio source and generate an audio signal;

a processor configured to:

form a plurality of audio beams from combinations of the audio signals generated from the plurality of bidirectional microphones, wherein each audio beam captures audio from either a respective positive polarity zone or a respective negative polarity zone;

determine a direction of the audio source;

select a perpendicular audio beam pair based on the direction of the audio source, wherein the selected perpendicular audio beam pair includes a primary audio beam aimed toward the direction of the audio source and a secondary audio beam perpendicular to the primary audio beam; and generate an output signal by combining the primary audio beam with the secondary audio beam based on a comparison of which respective polarity zones the audio is captured for the primary audio beam and the secondary audio beam.

9. The apparatus of claim 8, wherein the processor is further configured to calculate a signal-to-noise ratio (SNR) of each audio beam, and wherein the direction of the audio source is determined based on a comparison of the calculated SNRs of the audio beams.

10. The apparatus of claim 9, wherein the processor is configured to select the perpendicular audio beam pair by:

determining a maximum SNR among the calculated SNRs of the audio beams; and responsive to a determination that the maximum SNR is higher than a previously determined maximum SNR, selecting an audio beam with a minimum SNR as the secondary audio beam and selecting an audio beam perpendicular to the secondary audio beam as the primary audio beam.

11. The apparatus of claim 10, wherein the processor is configured to determine that the maximum SNR exceeds the previously determined maximum SNR by a first predetermined threshold.

12. The apparatus of claim 11, wherein the processor is further configured to:

calculate a difference between the maximum SNR and the minimum SNR;

compare the difference to a second predetermined threshold; and select the audio beam with the minimum SNR as the secondary audio beam only if the difference is greater than the second predetermined threshold.

13. The apparatus of claim 12, wherein the processor is further configured to select the audio beam perpendicular to the secondary audio beam as the primary audio beam only if the SNR of the audio beam perpendicular to the secondary audio beam is within a third predetermined threshold of the maximum SNR.

14. The apparatus of claim 8, wherein the processor is configured to form at least one of the audio beams by combining a first audio signal from a first bidirectional microphone with a time delayed second audio signal from a second bidirectional microphone.

15. One or more computer readable storage media encoded with software comprising computer executable instructions and, when the software is executed by a processor, cause the processor to:

receive audio of an audio source at a plurality of bidirectional microphones;

generate an audio signal from each of the bidirectional microphones;

form a plurality of audio beams from combinations of the audio signals generated from the plurality of bidirectional microphones, wherein each audio beam captures audio from either a respective positive polarity zone or a respective negative polarity zone;

determine a direction of the audio source;

select a perpendicular audio beam pair based on the direction of the audio source, wherein the selected perpendicular audio beam pair includes a primary audio beam aimed toward the direction of the audio source and a secondary audio beam perpendicular to the primary audio beam;

generate an output signal by combining the primary audio beam with the secondary audio beam based on a comparison of which respective polarity zones the audio is captured for the primary audio beam and the secondary audio beam.

16. The non-transitory computer readable storage media of claim 15, further comprising instructions operable to cause the processor to calculate a signal-to-noise ratio (SNR) of each audio beam, wherein the direction of the audio source is determined based on a comparison of the calculated SNRs of the audio beams.

17. The non-transitory computer readable storage media of claim 16, further comprising instructions operable to cause the processor to select the perpendicular audio beam pair by:

determining a maximum SNR among the calculated SNRs of the audio beams; and responsive to a determination that the maximum SNR is higher than a previously determined maximum SNR, selecting an audio beam with a minimum SNR as the secondary audio beam and selecting an audio beam perpendicular to the secondary audio beam as the primary audio beam.

18. The non-transitory computer readable storage media of claim 17, further comprising instructions operable to cause the processor to determine that the maximum SNR is higher than the previously determined maximum SNR by determining that the maximum SNR exceeds the previously determined maximum SNR by a first predetermined threshold.

19. The non-transitory computer readable storage media of claim 18, further comprising instructions operable to cause the processor to:

calculate a difference between the maximum SNR and the minimum SNR;

compare the difference to a second predetermined threshold; and select the audio beam with the minimum SNR as the secondary audio beam only if the difference is greater than the second predetermined threshold.

20. The non-transitory computer readable storage media of claim 19, further comprising instructions operable to cause the processor to select the audio beam perpendicular to the secondary audio beam as the primary audio beam only if the SNR of the audio beam perpendicular to the secondary audio beam is within a third predetermined threshold of the maximum SNR.

* * * * *